United States Patent [19]

Hobson et al.

[11] 4,343,526

[45] Aug. 10, 1982

[54] QUICK DISCONNECT ASSEMBLY

[75] Inventors: Ervin J. Hobson, Chicago; William J. Leitmann, Northbrook, both of Ill.

[73] Assignee: Hobson Bros., Inc., Chicago, Ill.

[21] Appl. No.: 119,163

[22] Filed: Feb. 6, 1980

[51] Int. Cl.[3] ..... H01R 13/54

[52] U.S. Cl. ..... 339/90 R; 339/94 R

[58] Field of Search ..... 339/89, 90, 94

[56] References Cited

U.S. PATENT DOCUMENTS

| | | | |
|---|---|---|---|
| 696,597 | 4/1902 | Russell | 339/89 R |
| 1,901,040 | 3/1933 | Peroni et al. | 339/94 R |
| 1,969,866 | 8/1934 | Wild et al. | 339/94 C |
| 2,337,800 | 12/1943 | Cassen | 339/89 R |
| 2,736,871 | 2/1956 | Bales | 339/94 C |
| 2,984,811 | 5/1961 | Hennessey, Jr. et al. | 339/94 M |
| 3,711,815 | 1/1973 | Pierce et al. | 339/94 M |
| 3,760,337 | 9/1973 | Johnson | 339/94 R |
| 3,824,526 | 7/1974 | Glover | 339/94 R |
| 3,902,779 | 9/1975 | Herbert | 339/89 R |

*Primary Examiner*—Joseph H. McGlynn

*Attorney, Agent, or Firm*—Neuman, Williams, Anderson & Olson

[57] ABSTRACT

A quick disconnect assembly is provided for use in a high voltage circuit. The assembly includes a housing having an elongated cavity closed at one end and open at the second or opposite end. The segment of the cavity proximate the second end is tapered with the narrow end thereof closest to the cavity closed end. A first electrical contact is disposed within the cavity and has a portion thereof disposed on the exterior of the housing. An elongated unit is removably positioned within the cavity and includes an insulated electrical lead having a second electrical contact formed on the end thereof and an elongated sleeve of insulative material disposed within the cavity and encompassing a portion of the lead. One end of the sleeve abuts the second electrical contact and the second end thereof terminates at the narrow end of the tapered cavity segment. A resilient seal piece encompasses a portion of the electrical lead extending from the second end of the sleeve. A cover member encompasses a portion of the electrical lead projecting from the cavity open end. The cover member when in one position is adjustable independently of the electrical lead and has a portion thereof encompassing and lockingly engaging a section of the housing adjacent the cavity open end causing the seal piece to be compressed and sealingly engage the tapered segment of the cavity and the first and second electrical contacts to positively engage one another.

5 Claims, 11 Drawing Figures

FIG. 1
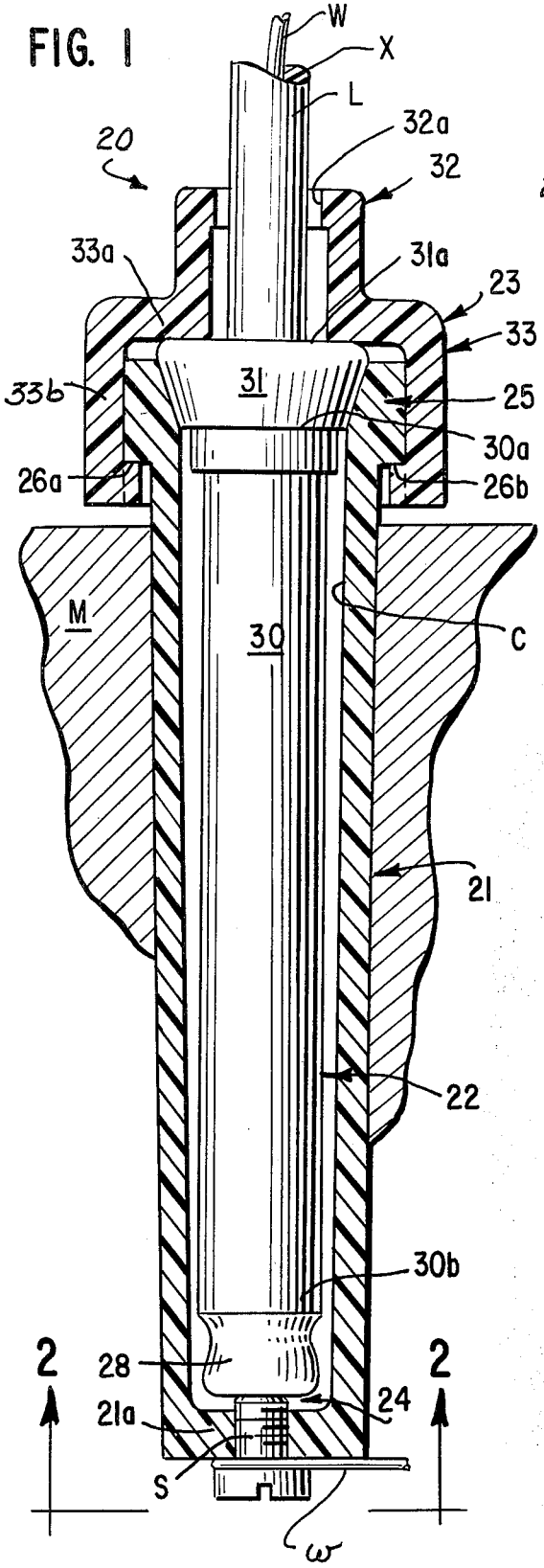
FIG. 2
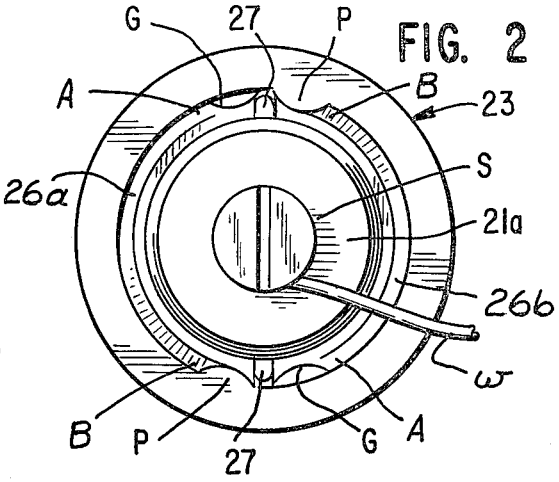
FIG. 7
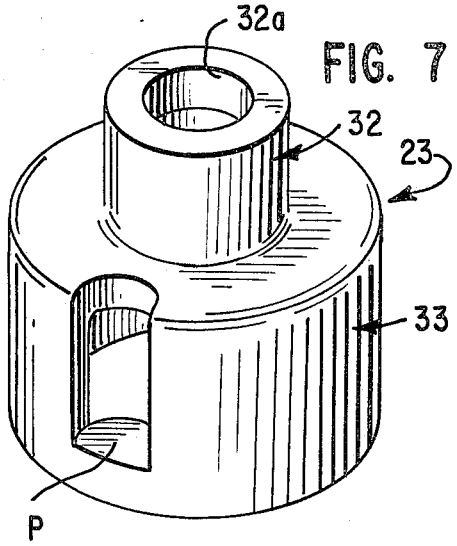
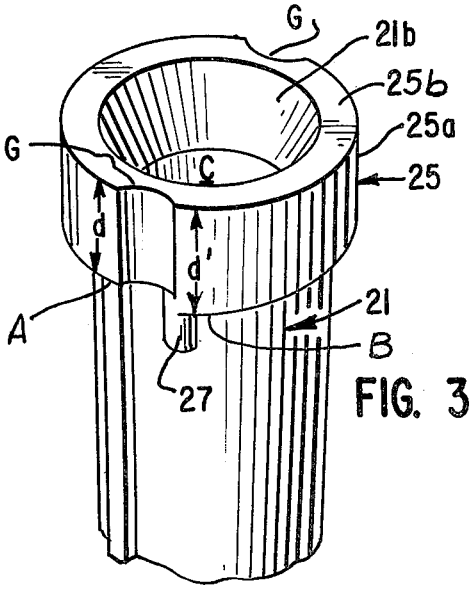
FIG. 3

QUICK DISCONNECT ASSEMBLY

BACKGROUND OF THE INVENTION

Various disconnect assemblies of this general type have heretofore been provided; however, because of inherent design characteristics they are possessed of one or more of the following shortcomings: (a) the device is formed of an inordinate number of components thereby significantly increasing the cost and complexity of the device; (b) the device is incapable of being used in circuits where the voltage exceeds 20,000 volts; (c) the device is susceptible to corona when subjected to high voltage; and (d) manual connecting and disconnecting thereof is an awkward manipulation.

SUMMARY OF THE INVENTION

Thus, it is an object of the invention to provide a quick disconnect assembly which avoids all of the aforenoted shortcomings.

It is a further object of the invention to provide a quick disconnect assembly which is strong, compact, and inexpensive, and capable of operating effectively over a wide voltage range.

Further and additional objects will appear from the description, accompanying drawings and appended claims.

In accordance with one embodiment of the invention, a quick disconnect assembly is provided which includes a housing of dielectric material. The housing is provided with an elongated cavity closed at one end and open at the opposite or second end. A segment of the cavity proximate the open end is tapered with the narrow end thereof closest to the closed end of the cavity. Mounted within the cavity is a first electrical contact having a portion extending to the exterior of the housing. Removably disposed within the cavity is an elongated unit provided with an insulated electrical lead having a second electrical contact disposed at an end thereof. An elongated sleeve of insulative material is disposed within the cavity and in encompassing relation with a portion of the electrical lead. One end of the sleeve is in abutting relation with the second electrical contact. The second end of the sleeve terminates at the narrow end of the tapered cavity segment. Engaging the sleeve second end and encompassing a portion of the electrical lead projecting from the sleeve is a resilient seal piece.

Mounted on the exposed portion of the electrical lead and movable longitudinally and rotatable independently thereof is a cover member. The cover member, when manually adjusted into an operative mode, has a portion thereof interlockingly engaging a section of the housing adjacent the cavity open end thereby causing the second electrical contact to positively engage the first electrical contact and the seal piece to sealingly engage the tapered cavity segment. When the cover member is manually adjusted into an inoperative mode, the cover member portion is unlocked from the housing section thereby enabling the electrical unit to be readily removed endwise from the cavity.

For a more complete understanding of the invention, reference should be made to the drawings wherein:

DESCRIPTION

FIG. 1 is a fragmentary vertical sectional view of one form of the improved quick disconnect assembly showing the cover member thereof in interlocking relation with the housing and the latter being potted in a dielectric material.

FIG. 2 is a bottom view of the assembly of FIG. 1 with the housing removed from the potting dielectric material.

FIG. 3 is a fragmentary top perspective view of the housing per se showing the open end of the cavity.

Figure 4:
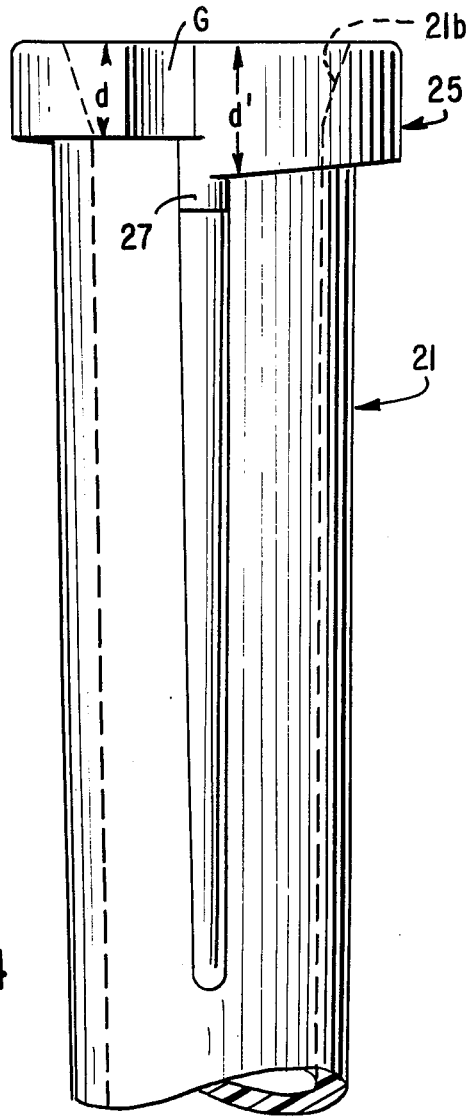
FIG. 4 is a fragmentary elevational view of the housing per se.
Figure 4A:
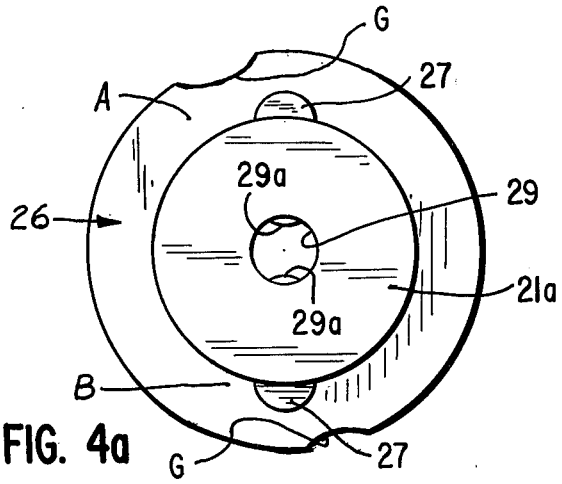

FIG. 4*a* is a bottom view of FIG. 4.

Figure 5:
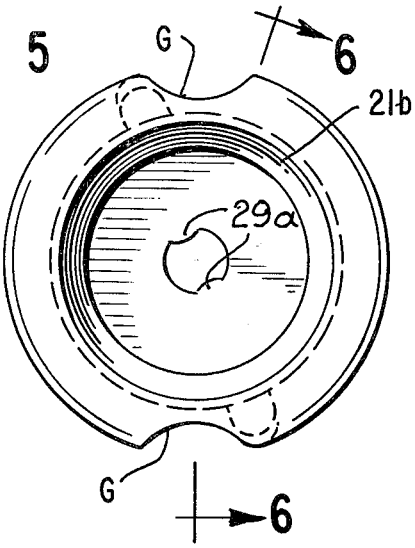

FIG. 5 is a top view of the housing of FIG. 4, the letter having been rotated a few degrees in a counterclockwise direction.

Figure 6:
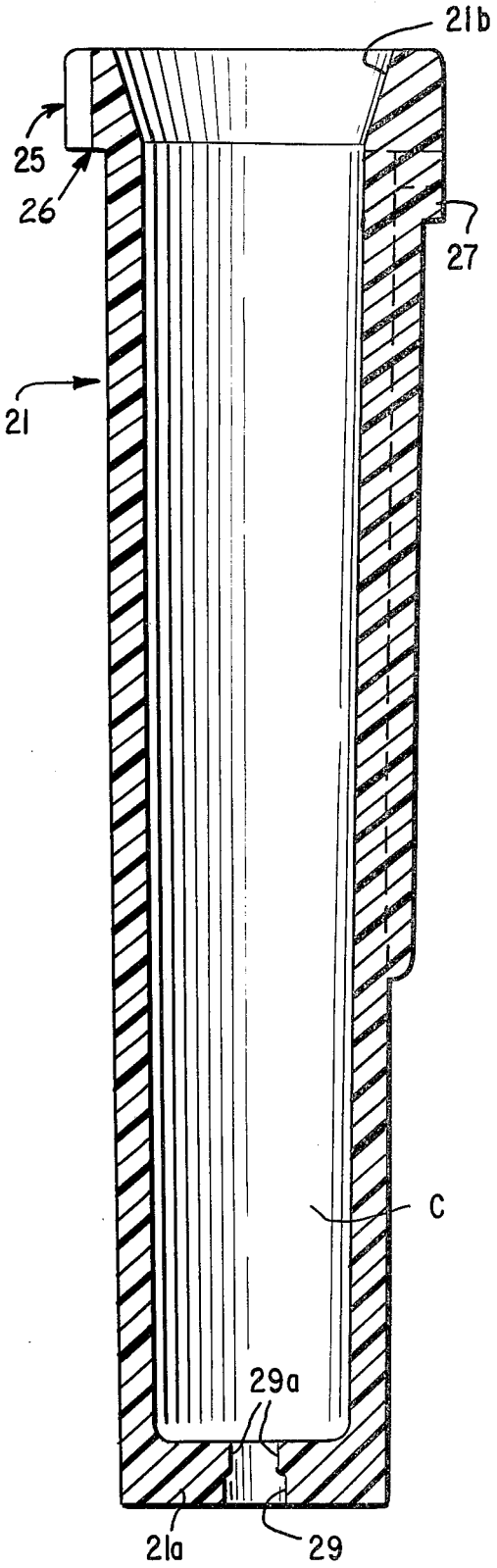

FIG. 6 is a sectional view taken along line 6—6 of FIG. 5.

FIG. 7 is a perspective view of the cover member per se.

Figure 8:
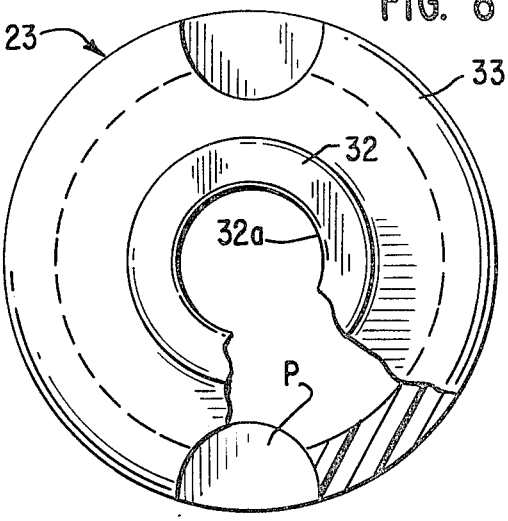

FIG. 8 is an enlarged top view of the cover member of FIG. 7.

Figure 9:
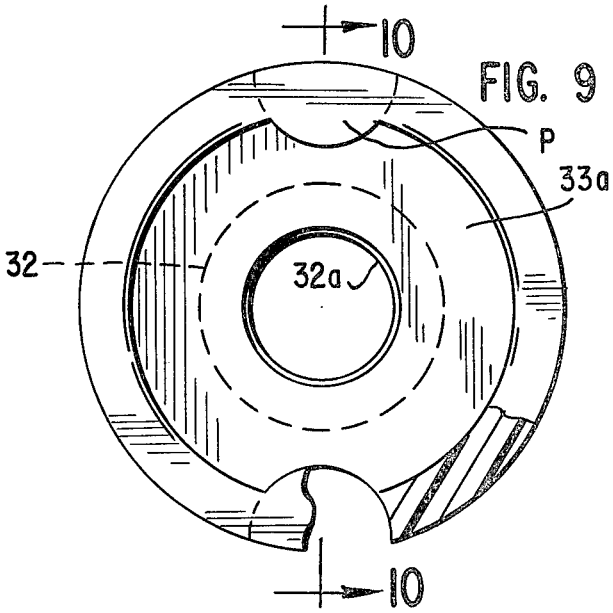

FIG. 9 is an enlarged bottom view of the cover member of FIG. 7.

Figure 10:
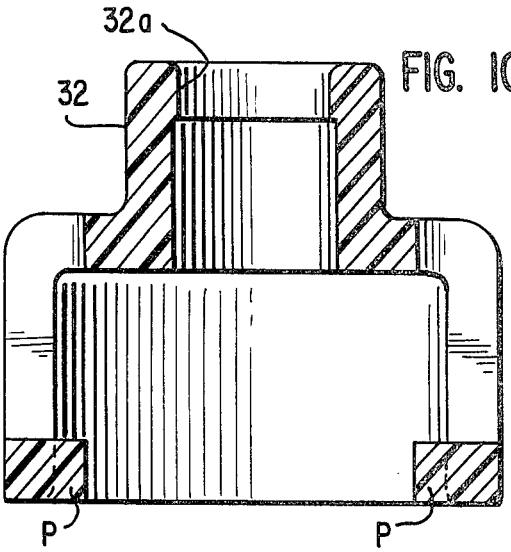

FIG. 10 is a sectional view taken along line 10—10 of FIG. 9.

Figure 11:
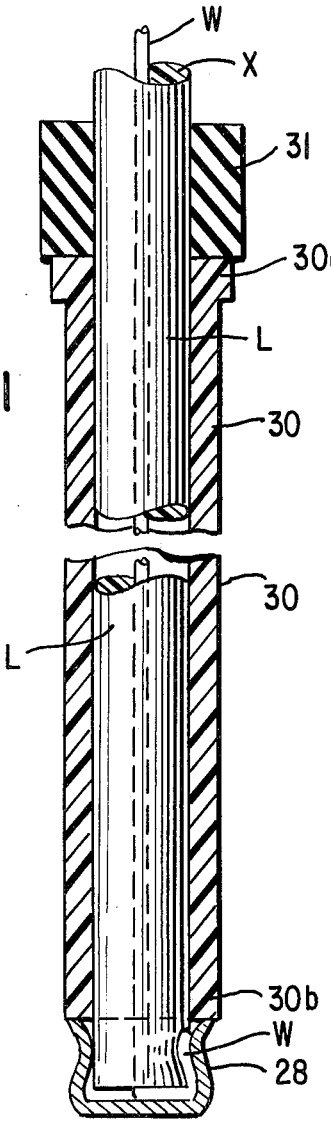

FIG. 11 is an enlarged fragmentary vertical sectional view of the elongated unit per se.

Referring now to the drawings and more particularly to FIG. 1, one form of an improved quick disconnect assembly 20 is shown which is adapted for use in a circuit wherein the voltage may be as high as 60,000 volts. Such voltages might be encountered in circuits utilized in certain types of television receivers and the like.

In circuits involving voltage of this magnitude, serious problems in the past have been encountered involving shock hazards and corona. In the assembly 20, hereinafter described, these problems have been effectively overcome. Assembly 20 embodies three basic components, a housing 21, an elongated unit 22 removably mounted within a cavity C formed in the housing, and a cover member 23 which is adapted to interlock with the housing and cause the unit to be retained within the cavity C.

The housing 21, as seen more clearly in FIGS. 3–6, is preferably molded of a dielectric material, (e.g., G.E. NORYL or G.E. VALOX). Housing 21, as illustrated, is of tubular configuration and has a substantial exterior portion thereof potted in a suitable dielectric material M forming a part of a high-voltage power supply, not shown. The closed end 21*a* of the cavity C is provided with a first electrical contact 24, which, in the illustrated embodiment, includes a metallic screw S which is threaded into the closed end 21*a*. The shank of the screw is of such a length that the leading end thereof projects into the cavity C. To effect proper sealing of the roots of the screw threads, an opening 29 formed in the closed end 21*a* may be provided with a pair of diametrically opposed projections 29*a* into which the screw will be threaded. The opening with the projections are initially molded in the housing.

Engaging the exposed head of the screw is a section of wire w, or the like, which is connected to the high-voltage power supply, not shown. While the contact 24 is shown to include a screw S, it will be readily understood that other means such as a rivet, or a conductor molded directly into the closed end could be substituted therefor.

The upper end of the cavity is open and has a segment 21b thereof tapered, as seen more clearly in FIG. 1. The function and purpose of the tapered segment will be described more fully hereinafter. Encompassing the tapered segment 21b of the cavity, is an external collar 25 which has the undersurface thereof—that is the surface closest to the closed end 21a—provided with an arcuate sectional cam 26. One cam section 26a is substantially diametrically opposite a cam section 26b, see FIG. 2. The beginning end A of each cam section is proximate an end of one of a pair of elongated grooves or flutes G formed in the exterior of a cylindrical wall 25a, see FIG. 3. The grooves extend in a direction substantially parallel to the longitudinal axis of cavity C and each is sized to slidably accommodate a protuberance P formed on the interior surface of cover member 23, as will be described more fully hereinafter.

Each cam section 26a, 26b is of like configuration and, as aforementioned, the beginning end A thereof is proximate an end of a groove G and the opposite end B of the cam section terminates at a stop 27. As will be seen in FIG. 4, the distance d the beginning end A of each cam section is spaced from the outer surface 25b of the collar 25 is less than the distance d' the end B of each cam section is spaced from same collar surface.

The elongated unit 22 is removably mounted within the cavity C and includes an electrical lead L of conventional design, an electrical contact 28 secured by crimping, soldering, or the like to the tip of the lead, a tubular sleeve 30 encompassing the portion of the lead disposed within the cavity, and a resilient seal piece 31 encompassing the portion of the lead protruding from the end 30a of the sleeve.

The lead L is provided with a wire core W which is enclosed within an insulative covering X, see FIG. 11. In the illustrated embodiment, the wire core W at one end extends from the inserted end of the lead and is folded back on the outside of the covering X and the contact 28, which is cup-shaped, receives the end of the lead and is crimped or soldered to the folded back portion of the wire core W. The upper rim portion 28a of the contact 28 flares outwardly from the exposed surface of the cover X and abuts the end 30b of the sleeve 30. As seen in FIG. 1, the sleeve end 30a terminates at the narrow end of the tapered segment 21b of the cavity C. As a result of this relationship, the resilient seal piece, which engages the sleeve end 30a, is disposed within the tapered cavity segment 21b when the unit 22 is assembled in cavity C. The upper or outer end 31a of the seal piece 31 protrudes beyond the open end of the cavity so that it will be engaged by the cover member 23 when the latter is manually adjusted into an operative mode. The seal piece 31 is preferably formed of a rubberlike material which is possessed of good dielectric characteristics (e.g., silicon rubber).

The cover member 23 is preferably of molded one-piece construction and formed of a dielectric material (e.g., G.E. NORYL). As viewed in FIG. 7, cover member 23 is provided with an upper section 32 and an enlarged lower section 33. The upper section is provided with a central bore 32a which slidably accommodates the portion of the lead L which projects outwardly from the seal piece 31 and is connected to an anode, not shown, or some other terminal. The lower section 33 is in the form of an inverted cup with the base 33a of the section engaging the upper end 31a of the seal piece 31. The depending cylindrical wall 33b of section 33 is sized so as to encompass the collar 25 formed on the end of the housing 21. The axial dimension of the wall 33b is greater than the measurement d' of the collar 25. As noted in FIG. 1, the lower open end of section 33 is provided with the inwardly-extending diametrically opposed protuberances P.

When the assembly 20 is to be adjusted to an operative mode, as seen in FIG. 1, the elongated unit 22 is inserted into the open end of the cavity C so that the seal piece 31 is in registration with the tapered cavity segment 21b. When in this relative position, the contact 28 will be in light contact with the contact 24. The cover member 23 is then rotated relative to the lead L so that the protuberances P are aligned with the upper ends of the grooves G. Once the protuberances are properly aligned, the cover member is manually moved axially of the lead L until the protuberances clear the opposite or lower end of each groove. To attain this clearance, the upper end 31a of the seal piece will be slightly compressed by the base 33a of section 33. When the protuberances P have cleared the lower ends of the grooves G, the cover member 23 is rotated in a counter-clockwise direction, as viewed in FIG. 2, so that each protuberance P will slide under the respective cam section 26a, 26b and apply further compressive force on the seal piece 31. The added compressive force applied to the seal piece will cause the latter to deform and sealingly engage the tapered cavity segment 21b. In addition to engaging the tapered segment, the seal piece will exert a resilient endwise force on the sleeve end 30a which, in turn, is transmitted to the electrical contact 28 causing same to make a positive electrical contact with the end of the screw S which projects into the cavity C. Because of this positive contact and the sealing engagement between the seal piece 31 and the tapered cavity segment 21b, the condition of corona is avoided when the circuit is energized. Corona is normally a common problem which occurs where high voltages 30,000–60,000 are involved.

The cover member 23, as viewed in FIG. 2, is rotated in a counter-clockwise direction until the protuberances engage the stops 27. At this point, the seal piece 31 is under maximum compression and the inherent resiliency of the seal piece will retain the cover member and the housing collar 25 in a positive interlocked relation. To move the protuberances P from the lower ends of the grooves G to the stops 27 requires a rotational movement of the cover member of approximately a half turn. The amount of rotational movement to effect interlocking of the cover member and collar may be less, if desired.

To effect the desired disconnect or inoperative mode of the assembly 20, requires a clockwise rotation of the cover member 23, as viewed in FIG. 2, so that the protuberances P will slide under the cam sections from the stops 27 into alignment with the lower ends of the grooves G, whereupon the cover member can be moved axially away from the end of the housing thereby allowing the unit 22 to be withdrawn from the cavity C.

The size and shape of the various components herein described may vary from that shown and will depend upon the location of the assembly relative to other elements included in the circuit. Also, the composition of the components may vary from that described and will depend in part upon the voltage range to which the circuit will be subjected.

We claim:

1. A quick disconnect assembly for use in a high voltage circuit, comprising an elongated housing of insulative material provided with a longitudinally extending cavity closed at one end and open at the opposite end, a segment of the cavity adjacent the open end being tapered with an enlarged end and a narrow end, the latter being disposed closest to the cavity closed end, a fixedly mounted first electrical contact disposed within the cavity adjacent the cavity closed end and having a portion thereof disposed on the housing exterior, said housing being provided with an external collar encompassing the cavity open end, said collar having a first surface closest to the cavity closed end, a second surface farthest removed from said cavity closed end, and a side surface connecting the first and second surfaces and being provided with at least one elongated external groove interconnecting the first and second collar surfaces and extending in a direction substantially parallel to the longitudinal axis of said housing, the collar first surface being provided with a substantially annular cam commencing from an end of said groove; an elongated unit in slidable engagement within said housing cavity, said unit including an elongated insulated electrical lead with a first portion thereof disposed within the cavity and a second portion thereof extending substantially longitudinally from the cavity open end, a second electrical contact carried on said lead first portion and in abutting engagement with said first electrical contact, a sleeve of substantially inflexible insulative material slidably encompassing said lead first portion, one end of said sleeve engaging said second electrical contact and a second end of said sleeve terminating between the narrow and enlarged ends of the tapered cavity segment upon the unit being initially assembled in the housing cavity, and a resilient seal piece snugly and slidably encompassing a section of the lead proximate the tapered cavity segment; and a cover member slidably and rotatably encompassing the lead second portion and being initially movable substantially axially of the housing and subsequently movable simultaneously rotatably and axially of said housing to effect locking of said cover member on said external collar, said cover member during the initial axial movement being guided by said groove exerting a first compressive force on said seal piece forcing the latter against the second end of the sleeve and effecting a first predetermined abutting force between said first and second electrical contacts, and during the subsequent simultaneous rotational and axial movement of the cover member being guided by said cam whereby said cover member exerts a greater compressive force on said seal piece increasing the abutting force between said first and second electrical contacts, said seal piece being in sealing engagement with the tapered cavity segment when said cover member and housing portion are in locking relation.

2. The quick disconnect assembly of claim 1 wherein said housing, said sleeve and said cover member are formed of substantially inflexible, lightweight, dielectric material.

3. The quick disconnect assembly of claim 1 wherein the first electrical contact includes a screw shank threaded into an opening formed in the closed end of the cavity, said opening including substantially symmetrically arranged projections engaged by said screw shank and extending inwardly further than the root diameter of said screw shank threads whereby said projections seal the roots of the threads.

4. The quick disconnect assembly of claim 1 wherein rotational movement of said cover member not in excess of a half turn during simultaneous rotational and axial movement effects a locking relation between said cover member and said external collar.

5. The quick disconnect assembly of claim 1 wherein the cover member includes a projection extending substantially radially inwardly from an exterior surface of said cover member encompassing said external collar, said projection initially engaging the collar groove and subsequently engaging the cam during movement of the cover member into locking relation with the collar.

* * * * *